United States Patent [19]

Schopf

[11] Patent Number: 4,981,093

[45] Date of Patent: Jan. 1, 1991

[54] SEWING MACHINE WITH A NEEDLE BAR MOUNTED IN A SWINGING FRAME

[75] Inventor: Karl-Dieter Schopf, Gerlingen, Fed. Rep. of Germany

[73] Assignee: Union Special G.m.b.h., Stuttgart, Fed. Rep. of Germany

[21] Appl. No.: 336,958

[22] Filed: Apr. 12, 1989

[30] Foreign Application Priority Data

Apr. 23, 1988 [DE] Fed. Rep. of Germany ..... 3813772

[51] Int. Cl.[5] ..... D05B 55/14

[52] U.S. Cl. ..... 112/221; 112/165; 112/322

[58] Field of Search ..... 112/221, 322, 165, 166, 112/167, 197, 199, 200, 321

[56] References Cited

U.S. PATENT DOCUMENTS

| | | | |
|---|---|---|---|
| 3,274,963 | 9/1966 | Keller et al. | 112/221 X |
| 3,460,494 | 8/1969 | Denker | 112/111 |
| 4,441,441 | 4/1984 | Bianchi | 112/221 |
| 4,582,007 | 4/1986 | Yamazawa et al. | 112/221 X |

FOREIGN PATENT DOCUMENTS

| | | | |
|---|---|---|---|
| 1680830 | 4/1972 | Fed. Rep. of Germany . | |
| 2120882 | 6/1987 | Japan | 112/321 |

*Primary Examiner*—Andrew M. Falik

*Attorney, Agent, or Firm*—Morgan & Finnegan

[57] ABSTRACT

A sewing machine has a needle bar, which is mounted in a frame, a continuously operating feed device for the workpiece, a looper which reciprocates transversely to the workpiece feed direction, a spindle which is mounted in the sewing machine arm, and a cam, which is disposed on the arm spindle in order to swing the frame in the workpiece feed direction. The frame is driven in dependence upon the movement of the arm spindle by way of a positively connected transmission. Two cams permit optimum adaptation of the swinging movement of the frame to the continuously moving workpiece.

4 Claims, 3 Drawing Sheets

SEWING MACHINE WITH A NEEDLE BAR MOUNTED IN A SWINGING FRAME

BACKGROUND OF THE INVENTION

The invention relates to a sewing machine having a needle bar mounted in a swinging frame.

The patent specification DEOS 1680830 U.S. Pat. No. 3,460,494 discloses a swing drive of a needle bar frame which is not fully positive, in that a spring biassed cam follower is pressed continuously against the periphery of a cam, which imparts a swinging movement to the needle bar frame. Although this design is simple in terms of parts, it does not allow such sewing machines to be used in high-speed machinery, for example for sewing or closing sacks, since this would place much more exacting requirements on such a needle bar swinging drive.

SUMMARY OF THE PRESENT INVENTION

It is an object of the invention to design a transmission which is suitable for swinging the needle bar frame and for readily transmitting the movement of the cam disc to the frame, even at high speeds, for example of up to 4,000 revolutions per minute.

The present invention resides in a sewing machine having a needle bar, which is mounted in a frame, can be moved up and down by a needle bar drive member and carries a needle, a continuously operative feed device for the workpiece, a looper which is adapted to be reciprocated transversely to the workpiece feed direction, a spindle mounted in the sewing machine arm, and positive transmission means including at least one cam which is disposed on the arm spindle, for positively swinging the frame back and forth in the workpiece feed direction, in dependence upon the movement of the arm spindle.

Using positive transmission means produces the advantage that the needle bar frame can be positively driven in dependence upon the movement of the arm spindle. This allows low-noise, high-speed swinging of the frame, and hence of the needle bar, in the workpiece feed direction.

The use of two cams, also called cam discs, and a crank lever which at least partially embraces the cams, is advantageous in that it not only allows the needle bar frame to be driven at high speed, but also allows optimum adaptation of the swinging movement of the frame to the continuous feed movement of the workpiece.

Preferably cam follower rollers are journalled to the crank lever. This permits the movements of the cams to be transmitted to the lever with a low amount of wear.

By mounting at least one of the follower rollers on an adjustable eccentric, tolerances in the transmission means can be compensated. Reciprocation of the needle bar can be stabilized to contribute towards reducing noise.

DESCRIPTION OF THE DRAWINGS

The invention is further described, by way of example, with reference to the accompanying drawings, in which.

DESCRIPTION OF THE PREFERRED EMBODIMENTS

Figure 1:
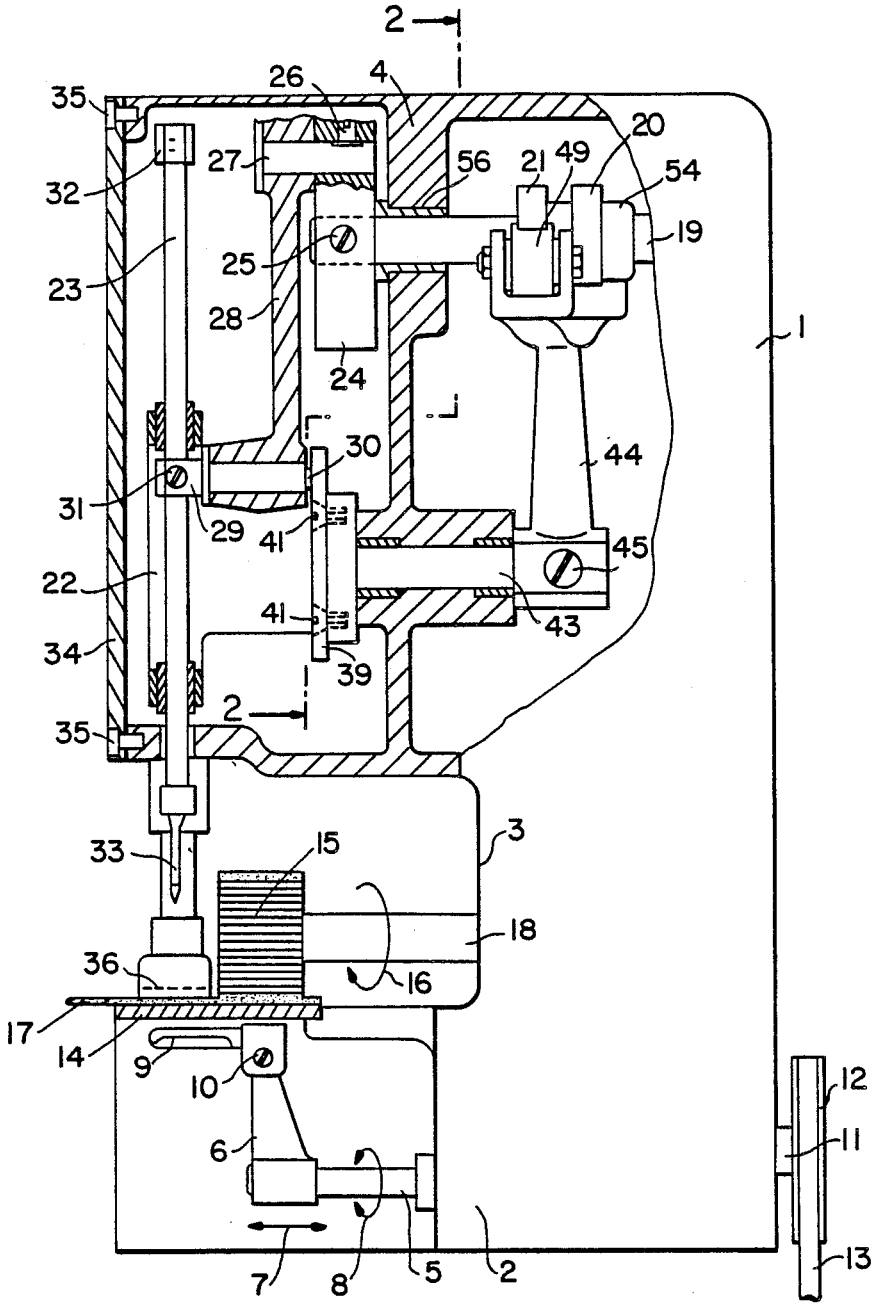
FIG. 1 is a partially sectioned front view of a sewing machine.

As shown in FIG. 1, a sewing machine has a housing 1, which comprises a base or lower part 2, a column 3 and a sewing machine arm 4. A looper spindle 5 reciprocates transversely to the workpiece feed direction, and is mounted in the base 2. The spindle 5 additionally carries out a swinging motion in the workpiece direction, and carries a looper holder 6. Double arrows 7 and 8 illustrate the directions of movement of the looper spindle 5. A straight looper 9 is clamped to the looper holder 6 by a screw 10. The looper spindle 5 is in driving connection with a main spindle 11 having therein a pulley 12 which is driven by a motor by way of a belt 13.

A workpiece 17 is moved in the workpiece feed direction between a needle plate 14, which is secured to the base 2, and a feed device, which is in the form of a roller 15 having a toothed periphery and is continuously driven in the direction of the arrow 16. A shaft 18 of the roller 15 extends from the column 3 and is also vertically movable.

Figure 2:
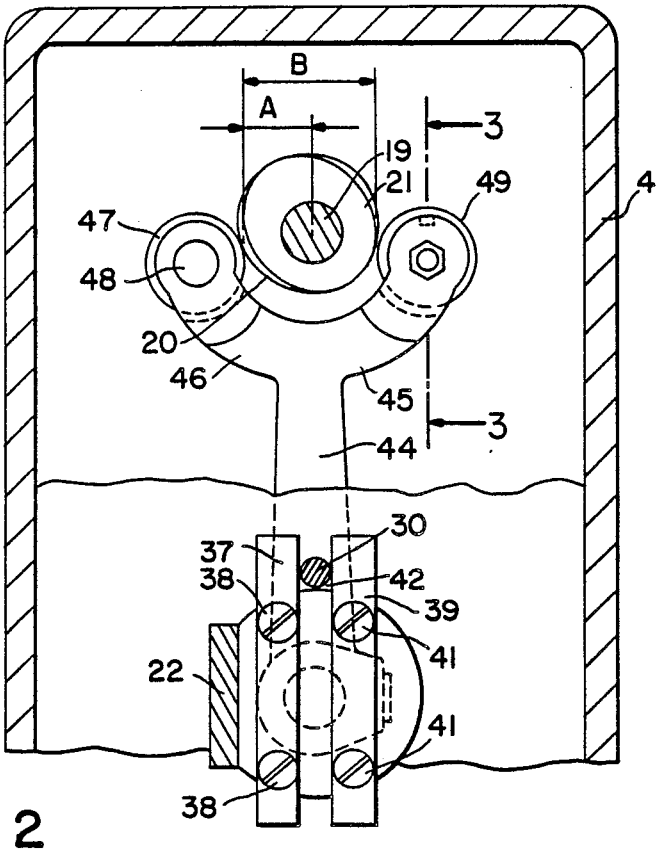
FIG. 2 is a larger-scale section along the line II-II of FIG. 1.
Figure 3:
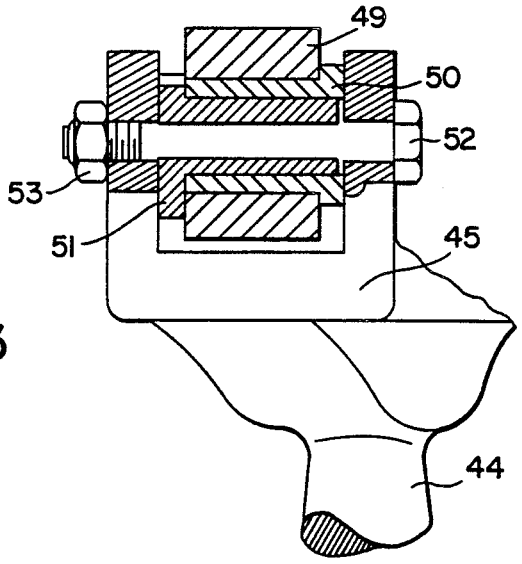
FIG. 3 is a larger-scale section along the line III-III of FIG. 2.

The main spindle 11 is connected by way of a toothed belt drive to a spindle 19, which is mounted in the sewing machine arm and carries a first cam disc 20 and an additional cam disc 21. The cams 20 and 21 form a spacing A and a positively operative spacing B in FIG. 2 for the purpose of swinging a needle bar frame 22 back and forth. In contrast to an eccentric-controlled drive of the frame 22, the further advantage of a cam-controlled drive of the frame 22 guiding a needle bar 23 is achieved.

The free end of the arm spindle 19, which is mounted in the sewing machine arm 4, carries a balance weight 24, which is fastened by a screw 25 on the arm spindle 19. A flanged bolt 27, which is fastened by a grub screw 26 in the balance weight 24, carries a connection rod 28, which in turn drives a needle bar drive member 29 having a pin 30, with the drive member 29 driving the needle bar 23 up and down. The needle bar drive member 29 is fixed by a screw 31 to the needle bar 23, whose upper end carries a thread guide 32 and whose lower end carries a needle 33. A cover 34 closes off the sewing machine arm 4 at the front end and is attached by means of screws 35. The workpiece 17, which may, for example, be a filled sack whose opening is being sewn up by a double-thread chain stitch seam is additionally guided by way of a holding-down device 36, which is resiliently mounted in the housing 1.

A strip 37 having screws 38 and a strip 39 having screws 41 are fastened to the needle bar frame 22 in such a way as to form a groove 42, into which the pin 30 of the needle bar drive member 29 engages, and is thus additionally guided in its up and down movement. The frame 22 is rigidly connected to a spindle 43, which is mounted in the sewing machine arm 4 and which supports the needle bar frame for oscillating movement. The free end of the spindle 43 carries a lever 44 which is fastened by a screw 45 on the oscillating spindle 43. The lever 44, which may also be in two parts, has a right arm 45 and a left arm 46, whose free ends are bifurcated. A cam follower roller 47 is rotatably mounted on a pin 48 in the bifurcated part of the left arm 46. A cam follower roller 49 is rotatably mounted on a bushing 50 and an eccentric part 51 in the bifurcated part of the right arm 45.

Figure 4:
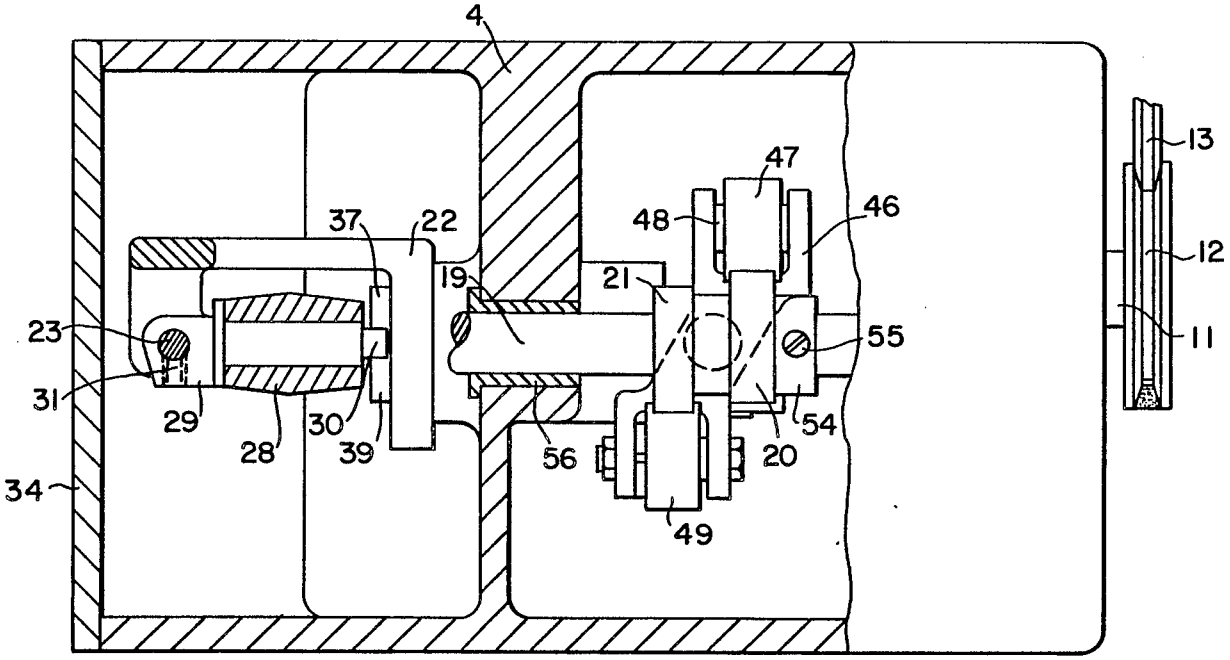
FIG. 4 is a partially sectioned, plan view of the sewing machine.

The eccentric part 51 together with the bushing 50 is prevented from rotating in the bifurcated part of the arm 45 by means of a screw 52 and a nut 53. This makes it possible to move the rollers 47 and 49 into close contact with the paths of the cam discs 20 and 21, and hence to reduce the noise of the transmission means 20, 21, 44, 43, 47 and 49 during operation. In FIG. 4, the cam discs 20 and 21 are in the form of a cam set 54 and are secured by a screw 55 on to the arm spindle 19, which is rotatably mounted in a bushing 56 in the sewing machine arm 4.

The arm spindle 19 is rotated from the main spindle 11 by way of the toothed belt drive (not shown) whereby the needle movement is synchronized with the looper movement. The rotational movement of the arm spindle produces the up and down motion of the needle bar 23 in a known manner by way of the balance weight 24, flanged bolt 27, connecting rod 28 and needle bar drive member 29. The cam discs 20 and 21 positively induce the swinging of the needle bar frame 22 in the workpiece feed direction by way of the rollers 47 and 49, the arm 44 and the oscillating spindle 43. The slight rolling resistance between the cam discs 20, 21 and the rollers 47 and 49 permit the frame 22 to be driven with a low amount of wear.

Instead of by way of the two cam discs 20 and 21, the positive swinging out of the frame 22 may also be achieved by way of an eccentric transmission, wherein, however, the swinging movement of the needle 33 can be adapted only approximately to the continuously moving workpiece 17. An eccentric, which is disposed on the arm spindle, may be guided in a fork of the arm 44. If, in a further embodiment, the arm 44 embraces the eccentric, the swinging movement may also be transmitted to the oscillating spindle 43 by way of an intermediate link.

The profiles of the cams 20 and 21 acting on the rollers 47 and 49 may, for example, be in the form of internal and external cam profiles which are disposed either concentrically or laterally on a disc, wherein the spacing between the internal and external cam profiles in relation to the rollers provides a positive drive in both directions. The lever 44 also executes a positively driven movement in such an embodiment.

What is claimed is:

1. A sewing machine for sewing a workpiece having a workpiece feed direction, a sewing machine arm, a needle bar which is mounted in a frame can be moved up and down by a needle bar drive member and carries a needle, a continuously operative feed device for the workpiece, a looper which is adapted to be reciprocated transversely to the workpiece feed direction, an arm spindle mounted in the sewing machine arm, and positive transmission means including at least one cam which is disposed on the arm spindle, for positively swinging the frame back and forth in the workpiece feed direction, in dependence upon the movement of the arm spindle, in which the arm spindle is coupled to the needle bar frame by way of at least one additional cam, which is disposed on the arm spindle, and by way of a bilaterally operative crank lever, which at least partially embraces the cams, wherein the cams form a positively operative spacing for the purpose of swinging the frame back and forth.

2. A sewing machine as claimed in claim 1, in which rollers are rotatably disposed on the crank lever and transmit the movement of the cams to the crank lever.

3. A sewing machine as claimed in claim 2, in which at least one roller is rotatably mounted on an eccentric part, which is fastened on the crank lever.

4. A sewing machine as claimed in claim 1, in which the needle bar frame has a groove, into which a pin of the needle bar drive member engages to stabilize reciprocation of the needle bar relative to the frame.

* * * * *